US011867441B2

(12) United States Patent
Mai et al.

(10) Patent No.: US 11,867,441 B2
(45) Date of Patent: Jan. 9, 2024

(54) NON-STOP DEFROSTING MULTI-CONNECTED HOT WATER SYSTEM AND CONTROL METHOD THEREOF

(71) Applicant: Guangdong Giwee Technology Co. Ltd., Foshan (CN)

(72) Inventors: Xiangshi Mai, Foshan (CN); Defu Gao, Foshan (CN); Hongbin Liu, Foshan (CN)

(73) Assignee: Guangdong Giwee Technology Co. Ltd., Foshan (CN)

( * ) Notice: Subject to any disclaimer, the term of this patent is extended or adjusted under 35 U.S.C. 154(b) by 61 days.

(21) Appl. No.: 17/582,344

(22) Filed: Jan. 24, 2022

(65) Prior Publication Data

US 2022/0235983 A1 Jul. 28, 2022

(30) Foreign Application Priority Data

Jan. 25, 2021 (CN) ..... 202110092928.7

(51) Int. Cl.

| | |
|---|---|
| ***F25B 13/00*** | (2006.01) |
| ***F25B 47/02*** | (2006.01) |
| ***F25B 41/20*** | (2021.01) |
| ***F25B 49/02*** | (2006.01) |

(52) U.S. Cl.

CPC ..... *F25B 47/02* (2013.01); *F25B 13/00* (2013.01); *F25B 41/20* (2021.01); *F25B 49/02* (2013.01); *F25B 2313/0231* (2013.01); *F25B 2600/2513* (2013.01)

(58) Field of Classification Search

CPC ..... F25B 47/02; F25B 41/20; F25B 13/00; F25B 13/0231; F25B 2600/2513

See application file for complete search history.

(56) References Cited

U.S. PATENT DOCUMENTS

2014/0298855 A1* 10/2014 Kang ..... F25B 1/005 62/498

FOREIGN PATENT DOCUMENTS

| | | | | |
|---|---|---|---|---|
| CN | 106123388 A | | 11/2016 | |
| CN | 109405102 A | * | 3/2019 | ..... F24D 17/0005 |
| CN | 109405102 A | | 3/2019 | |
| CN | 112050494 A | | 12/2020 | |
| EP | 2876386 A1 | | 5/2015 | |

OTHER PUBLICATIONS

Cao, Air-Conditioning System, 2018, Full Document (Year: 2018).*

European Search Report for application EP 22153048.8, dated Jun. 8, 2022, 9 pages.

* cited by examiner

*Primary Examiner* — Nael N Babaa

(74) *Attorney, Agent, or Firm* — CANTOR COLBURN LLP

(57) ABSTRACT

A non-stop defrosting multi-connected hot water system and a control method. Heat is recovered by utilizing the characteristic of a phase-change heat storage module that can store heat, and then the heat is released during defrosting. In a defrosting process, modes of a hydraulic module and an indoor unit are not changed, and a four-way valve is not reversed, so as to avoid the influence of the defrosting process on an indoor ambient temperature and a water temperature of the hydraulic module, and avoid the condition where a liquid refrigerant generated in the defrosting process does not evaporate and directly flows back into a compressor which causes liquid return of the compressor, thus improving the reliability of the overall operation of the system.

9 Claims, 1 Drawing Sheet

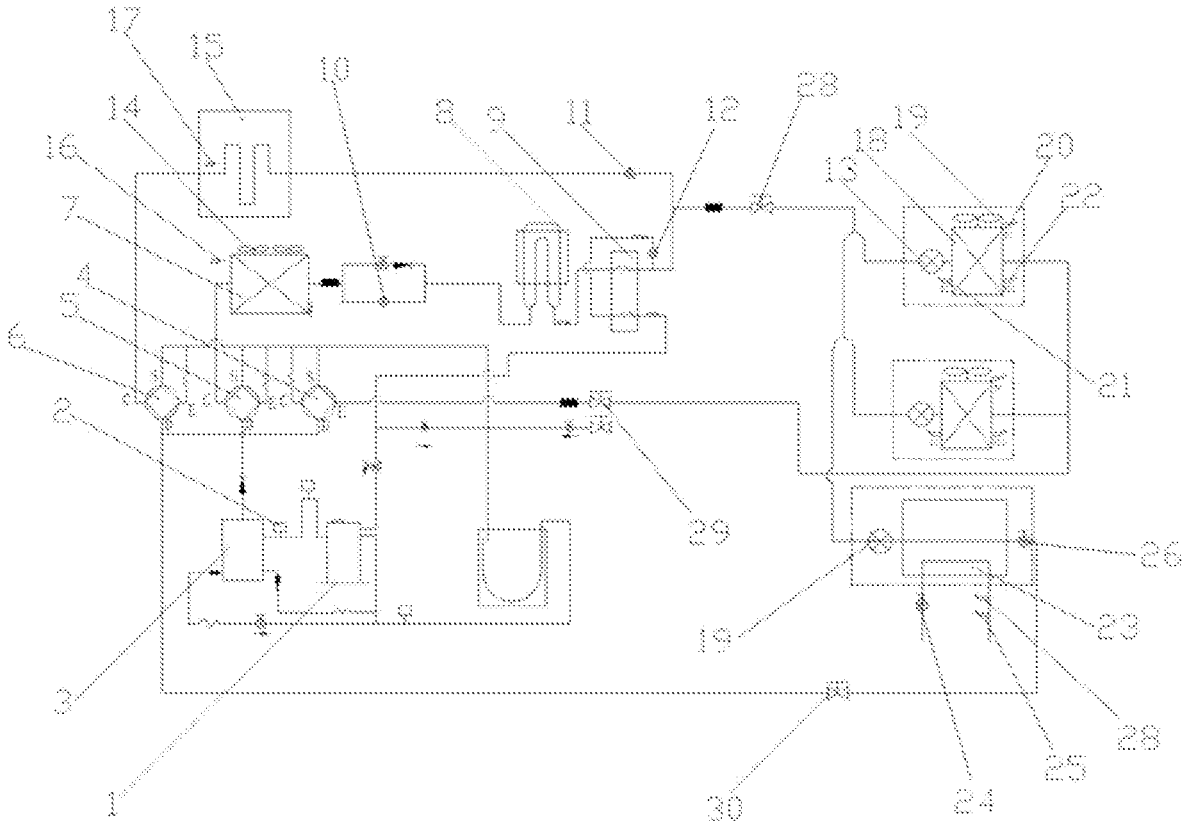
17
15
10
14
8
9
11
12
28
19
16
18
20
13
22
7
4
5
6
21
2
29
26
19
23
3
28
25
1
30
24

NON-STOP DEFROSTING MULTI-CONNECTED HOT WATER SYSTEM AND CONTROL METHOD THEREOF

FOREIGN PRIORITY

This application claims priority to Chinese Patent Application No. 2021100929287, filed Jan. 25, 2021, and all the benefits accruing therefrom under 35 U.S.C. § 119, the contents of which in its entirety are herein incorporated by reference.

TECHNICAL FIELD

The present disclosure relates to the technical field of air conditioners, and in particular, to a non-stop defrosting multi-connected hot water system and a control method thereof.

BACKGROUND

When in a hot water making or air conditioning heating mode, an existing multi-connected hot water system needs to use a hydraulic module or an indoor unit as an evaporator to absorb heat during defrosting. In order to reduce influences of the defrosting process on an indoor ambient temperature and not turning on the indoor unit, in the defrosting process, the indoor unit generally enters an anti-cold air mode, the indoor unit fan is not turned on, and a large amount of liquid refrigerant flows through the indoor unit and returns to a compressor. This process is prone to cause liquid impact on the compressor, thus affecting the service life of the compressor and the system reliability. The use of the hydraulic module or indoor unit as an evaporator in the defrosting process will cause the water temperature of the hydraulic module to drop, or cause the ambient temperature at the inner side of the air conditioner to drop, thus affecting the user experience. At the same time, a four-way valve needs to be reversed in the defrosting process, and it is difficult to effectively heat or make hot water, which reduces effective heating time or hot water production time of the air-conditioner, resulting in a low effective utilization rate of the equipment.

During defrosting of a conventional multi-connected hot water system, it is necessary to control the four-way valve of the indoor unit or the hydraulic module to reverse. An impact sound of the refrigerant during the reversing of the four-way valve of the indoor unit will cause a large noise on the side of the indoor unit. At the same time, if the hydraulic module is used for reversing to prevent the sound of refrigerant flowing generated by a large amount of refrigerant passing through in the indoor unit defrosting process from seriously affecting the user experience, a large amount of low-pressure liquid refrigerant will flow through the hydraulic module, which is easy to cause the hydraulic module to freeze and damage the hydraulic module.

The conventional multi-connected hot water system cannot effectively store heat during standby, resulting in a waste of use time and low equipment use efficiency. Because there is no phase-change heat storage module, the outdoor unit acts as a condenser in a cooling process of the indoor unit, and the heat absorbed from the indoor unit will be discharged into the natural environment instead of being effectively recovered and stored as high-grade energy, which reduces the efficiency of energy use and causes energy waste.

SUMMARY

The present disclosure aims to at least solve the technical problems existing in the prior art, for this purpose, a non-stop defrosting multi-connected hot water system is proposed, and the non-stop defrosting multi-connected hot water system is high in reliability.

A control method of a non-stop defrosting multi-connected hot water system is provided in the present invention.

According to an embodiment of a first aspect of the present invention, a non-stop defrosting multi-connected hot water system comprises: an outdoor unit comprising a compressor, a high-pressure pressure sensor, an oil separator, a first switching device, a second switching device, a third switching device, a fin type heat exchanger, a compressor heat-dissipation module, a plate type heat exchanger, a first throttling device, a second throttling device, a third throttling device, an outdoor unit fan, and a phase-change heat storage module with a heat storage function, and further comprising an outdoor unit ambient temperature sensor configured to detect an ambient temperature of the outdoor unit in real time and a phase-change heat storage module temperature sensor configured to detect a temperature of the phase-change heat storage module in real time; multi-connected indoor units, at least one indoor unit comprising an indoor unit heat exchanger, a fourth throttling device, an indoor unit fan, and an indoor unit ambient temperature sensor configured to detect an ambient temperature of the indoor unit in real time, wherein the indoor unit heat exchanger is further provided with an indoor unit heat exchanger central temperature sensor and an indoor unit heat exchanger outlet temperature sensor that are configured for real-time detection; and a hydraulic module comprising a refrigerant water heat exchanger, a water pump, a water flow switch, a solenoid valve, and a water temperature detection sensor.

According to some embodiments of the present invention, a liquid side stop valve, a gas side stop valve, and a hydraulic module stop valve that are connected to the outside of the outdoor unit are further comprised.

According to some embodiments of the present invention, the liquid side stop valve is connected to an indoor unit liquid pipe and a hydraulic module liquid pipe.

According to some embodiments of the present invention, the gas side stop valve is connected to an indoor unit gas pipe.

According to some embodiments of the present invention, the hydraulic module stop valve is connected to a hydraulic module gas pipe.

According to some embodiments of the present invention, the first throttling device, the second throttling device, the third throttling device, and the fourth throttling device are all electronic expansion valves.

According to some embodiments of the present invention, the first switching device, the second switching device, and the third switching device are all four-way valves.

According to some embodiments of the present invention, the compressor adopts a frequency inverter compressor, a fixed speed compressor, or a digital compressor.

According to an embodiment of a second aspect of the present invention, a control method of a non-stop defrosting multi-connected hot water system is provided, and the non-stop defrosting multi-connected hot water system is the non-stop defrosting multi-connected hot water system according to the first aspect of the present invention, wherein working modes of the outdoor unit, the indoor unit, and the hydraulic module comprise a cooling mode, a heating mode, a standby mode, and a defrosting mode, and based on energy requirements of the working mode of the system, actions of components in the outdoor unit, the indoor unit, and the hydraulic module are respectively adjusted correspondingly: when the indoor unit and the hydraulic module are in the standby mode, by checking a T4 temperature of the outdoor unit ambient temperature sensor, when the ambient temperature is lower than TS2, it is defaulted to enter a standby heat storage mode, the first switching device is in a power-off state, the second switching device is in a power-on state, and the third switching device is in a power-off state; when the indoor unit is in the cooling mode and the hydraulic module enters the heating mode, the phase-change heat storage module starts to store heat, and at this time, the first switching device is in the power-off state, the second switching device is in the power-on state, and the third switching device is in the power-off state; when the outdoor unit enters the defrosting mode, the second throttling device is opened to the maximum opening degree of 480P, the first switching device is in the power-off state, the second switching device is in the power-off state, and the third switching device is in the power-on state; when the indoor unit is in the standby mode and the hydraulic module enters the heating mode to make hot water, the phase-change heat storage module starts to store heat, the first switching device is in the power-off state, and the second switching device is in the power-on state, and the third switching device is in the power-off state; when the outdoor unit enters the defrosting state, the second throttling device is opened to the maximum opening degree of 480P, the first switching device is in the power-off state, the second switching device is in the power-off state, the third switching device is in the power-on, and the hydraulic module keeps heating; when the indoor unit is in the heating mode and the hydraulic module is also making hot water, the phase-change heat storage module starts to store heat, the first switching device is in the power-on state, the second switching device is in the power-on state, and the third switching device is in the power-off state; when the outdoor unit enters the defrosting mode, the second throttling device is opened to the maximum opening degree of 480P, the first switching device is in the power-on state, the second switching device is in the power-off state, and the third switching device is in the power-on state; when the indoor unit is in the heating mode, the phase-change heat storage module starts to store heat, and at this time, the first switching device is in the power-on state, the second switching device is in the power-on state, and the third switching device is in the power-off state; and when the outdoor unit enters the defrosting mode, the second throttling device is opened to the maximum opening degree of 480P, the first switching device is in the power-on state, the second switching device is in the power-off state, the third switching device is in the power-on state, and an operating state of an internal unit remains unchanged.

According to some embodiments of the present invention, a value measured by the indoor unit ambient temperature sensor is defined as T1, a value measured by the indoor unit heat exchanger central temperature sensor is defined as T2, a value measured by the indoor unit heat exchanger outlet temperature sensor is defined as T2B, a value measured by the phase-change heat storage module temperature sensor is defined as T9, and a value measured by the outdoor unit ambient temperature sensor is defined as T4.

By adopting the above solutions, the present invention has the following beneficial effects: utilizing the characteristic of the phase-change heat storage module that can store heat, heat recovery is carried out, and then the heat is released during defrosting, so that modes of the hydraulic module and indoor unit are unchanged in the defrosting process, and the four-way valve is not reversed, which avoids the influence of the defrosting process on the indoor ambient temperature and the water temperature of the hydraulic module, and avoids the condition where the liquid refrigerant generated in the defrosting process does not evaporate and directly flows back into the compressor which causes liquid return of the compressor, thus increasing the reliability of the overall operation of the system. At the same time, components of the internal unit and the hydraulic module are controlled so that they do not need to be reversed during defrosting, which can ensure the stable operation of the system, and also avoid the reversing noise and the sound of refrigerant flowing in the defrosting process. The heat storage module is used to achieve effective storage and recovery of high-grade heat energy, thus improving the energy efficiency and reducing the energy consumption.

BRIEF DESCRIPTION OF THE DRAWINGS

FIG. 1 is a schematic structural diagram of the present invention.

Reference numerals in the drawing: 1—Compressor, 2—High-pressure pressure sensor, 3—Oil separator, 4—First switching device, 5—Second switching device, 6—Third switching device, 7—Fin type heat exchanger, 8—Compressor heat-dissipation module, 9—Plate type heat exchanger, 10—First throttling device, 11—Second throttling device, 12—Third throttling device, 13—Fourth throttling device, 14—Outdoor unit fan, 15—Phase-change heat storage module, 16—Outdoor unit ambient temperature sensor, 17—Phase-change heat storage module temperature sensor, 18—Indoor unit heat exchanger, 19—Indoor unit fan, 20—Indoor unit ambient temperature sensor, 21—Indoor unit heat exchanger central temperature sensor, 22—Indoor unit heat exchanger outlet temperature sensor, 23—Refrigerant water heat exchanger, 24—Water pump, 25—Water flow switch, 26—Solenoid valve, 27—Water temperature detection sensor, 28—Liquid side stop valve, 29—Gas side stop valve, and 30—Hydraulic module stop valve.

DETAILED DESCRIPTION

The technical solutions in the embodiments of the present invention will be clearly and completely described below with reference to the accompanying drawings in the embodiments of the present invention. Obviously, the described embodiments are only a part of the embodiments of the present invention, rather than all the embodiments. Based on the embodiments of the present invention, all other embodiments obtained by those of ordinary skill in the art without creative efforts shall fall within the protection scope of the present invention.

In the description of the present invention, it should be noted that, unless otherwise expressly specified and limited, terms "installed," "connected," and "in connection" should be understood in a broad sense. For example, it may be a fixed connection, a detachable connection, or an integral connection; it may be a mechanical connection; it may be a direct connection, or indirect connection through an intermediate medium, or an internal communication between two components. For those of ordinary skill in the art, the specific meanings of the above terms in the present invention can be understood in specific situations.

In the description of the present invention, "and/or" is only an association relationship that describes associated objects, indicating that there may be three kinds of relationships. For example, A and/or B may indicate three cases including that A exists alone, A and B exist simultaneously, and B exists alone. In addition, the character "/" herein generally indicates that associated objects before and after the character are in an "or" relationship.

Referring to FIG. 1, a non-stop defrosting multi-connected hot water system includes:

an outdoor unit including a compressor 1, a high-pressure pressure sensor 2, an oil separator 3, a first switching device 4, a second switching device 5, a third switching device 6, a fin type heat exchanger 7, a compressor heat-dissipation module 8, a plate type heat exchanger 9, a first throttling device 10, a second throttling device 11, a third throttling device 12, an outdoor unit fan 14, and a phase-change heat storage module 15 with a heat storage function, and further including an outdoor unit ambient temperature sensor 18 configured to detect an ambient temperature of the outdoor unit in real time and a phase-change heat storage module temperature sensor 15 configured to detect a temperature of the phase-change heat storage module 15 in real time;

multi-connected indoor units, at least one indoor unit including an indoor unit heat exchanger 18, a fourth throttling device 13, an indoor unit fan 19, and an indoor unit ambient temperature sensor 20 configured to detect an ambient temperature of the indoor unit in real time, wherein the indoor unit heat exchanger 18 is further provided with an indoor unit heat exchanger central temperature sensor 21 and an indoor unit heat exchanger outlet temperature sensor 22 that are configured for real-time detection; and a hydraulic module including a refrigerant water heat exchanger 23, a water pump 24, a water flow switch 25, a solenoid valve 26, and a water temperature detection sensor 27.

The indoor unit ambient temperature sensor 20 is configured to detect an ambient temperature of the indoor unit in real time, and a measured value is T1. The indoor unit heat exchanger central temperature sensor 21 is configured to detect a central temperature of the indoor unit heat exchanger in real time, and a measured value is T2. The indoor unit heat exchanger outlet temperature sensor 22 is configured to detect an outlet temperature of the indoor unit heat exchanger, and a measured value is T2B. The phase-change heat storage module temperature sensor 17 is configured to detect phase-change heat storage in real time, and a measured value is T9. The outdoor unit ambient temperature sensor 16 is configured to detect an ambient temperature of the outdoor unit in real time, and a measured value is T4.

Further, a liquid side stop valve 28, a gas side stop valve 29, and a hydraulic module stop valve 30 that are connected to the outside of the outdoor unit may further be included.

Further, the liquid side stop valve 28 is connected to an indoor unit liquid pipe and a hydraulic module liquid pipe.

Further, the gas side stop valve 29 is connected to an indoor unit gas pipe.

Further, the hydraulic module cut-off valve 30 is connected to a hydraulic module gas pipe.

Further, the first throttling device 10, the second throttling device 11, the third throttling device 12, and the fourth throttling device 13 are all electronic expansion valves.

Further, the first switching device 4, the second switching device 5, and the third switching device 6 are all four-way valves.

Further, the compressor 1 adopts an inverter compressor 1, a fixed speed compressor 1, or a digital compressor 1.

In order to facilitate understanding, working principles of the system will now be further described with reference to specific embodiments.

Working modes of the outdoor unit, the indoor unit, and the hydraulic module include a cooling mode, a heating mode, a standby mode, and a defrosting mode, wherein based on energy requirements of the working mode of the system, actions of components in the outdoor unit, the indoor unit, and the hydraulic module are respectively adjusted correspondingly.

When the indoor unit and hydraulic module are in the standby mode, a T4 temperature of the outdoor unit ambient temperature sensor 18 is checked. When the ambient temperature is lower than TS2, the standby heat storage mode is entered by default. At this time, the outdoor unit of the air conditioner is turned on to perform heat storage for the phase-change heat storage module 15. The compressor 1 in the outdoor unit of the air conditioner is started, the outdoor unit fan 14 is turned on, the first switching device 4 is in a power-off state, the second switching device 5 is in a power-on state, and the third switching device 6 is in a power-off state. The fourth throttling device 13 of the indoor unit of the air conditioner, the solenoid valve 26 of the hydraulic module, and the fourth throttling device 13 are all closed, and the phase-change heat storage module 15 enters a standby heat storage process. At this time, a high-temperature and high-pressure gaseous refrigerant is discharged from the compressor 1, enters the phase-change heat storage module 15 through the third switching device 6, releases heat in the phase-change heat storage module 15, condenses from the high-temperature and high-pressure gaseous refrigerant into a high-temperature and high-pressure liquid refrigerant, and then flows through the second throttling device 11, the plate type heat exchanger 9, the refrigerant heat-dissipation module, the first throttling device 10, and the outdoor unit fin type heat exchanger 7. After evaporated in the outdoor unit fin type heat exchanger 7 to absorb heat, the liquid refrigerant then returns to the compressor 1 via the second switching device 5 to realize standby heat storage, so as to defrost the outdoor unit, during defrosting, by using the heat stored in the phase-change heat storage module 15.

When the indoor unit is in the cooling mode and the hydraulic module enters the heating mode, the phase-change heat storage module 15 starts to store heat. At this time, the first switching device 4 is in the power-off state, the second switching device 5 is in the power-on state, and the third switching device 6 is in the power-off state. The high-temperature and high-pressure refrigerant is condensed through the hydraulic module or the phase-change heat storage module 15, and evaporated in the outdoor unit, so that the phase-change heat storage module 15 stores heat. When the temperature T9 of the internal sensor of the phase-change heat storage module 15 is checked as that the phase-change heat storage temperature is lower than a required temperature Tx2, the second throttling device 11 is opened to the maximum of 480P, the refrigerant passes through the phase-change heat storage module 15 or the hydraulic module, and then enters the indoor unit or the outdoor unit to evaporate. The phase-change heat storage module 15 absorbs and stores the heat, and the phase-change heat storage module 15 functions for heat recovery. When the temperature T9 of the phase-change heat storage module 15 reaches a required temperature Tx1, the opening of the second throttling device 11 is reduced to the standby opening of 56P, so that the phase-change heat storage module 15 does not absorb heat, the phase-change heat storage module 15 is in a standby state, and the whole system is controlled as normal.

When the outdoor unit enters the defrosting mode, the second throttling device 11 is opened to the maximum opening degree of 480P, the first switching device 4 is in the power-off state, the second switching device 5 is in the power-off state, and the third switching device 6 is in the power-on state. At this time, the high-temperature and high-pressure gaseous refrigerant flows through the outdoor unit heat exchanger to defrost the outdoor unit fin type heat exchanger 7, and then flows to the phase-change heat storage module 15 so that the refrigerant is evaporated and absorbs heat in the phase-change heat storage module 15. At the same time, the state of the first switching device 4 does not change in the defrosting process, the operating state of the indoor unit does not change, and its cooling state is maintained, so it is ensured that the defrosting process does not affect the operating states of the hydraulic module and the indoor unit.

When the indoor unit is in the standby mode and the hydraulic module enters the heating mode to make hot water, the phase-change heat storage module 15 starts to store heat. At this time, the first switching device 4 is in the power-off state, the second switching device 5 is in the power-on state, the third switching device 6 is in the power-off state, and the fourth throttling device 13 of the indoor unit is fully closed. The high-temperature and high-pressure refrigerant is condensed through the hydraulic module or the phase-change heat storage module 15, and evaporated in the outdoor unit, so that the phase-change heat storage module 15 stores heat. When the temperature T9 of the internal sensor of the phase-change heat storage module 15 is checked as that the phase-change heat storage temperature is lower than a required temperature Tx2, the second throttling device 11 is opened to the maximum of 480P, the refrigerant passes through the phase-change heat storage module 15 or the hydraulic module, and then enters the outdoor unit to evaporate. The phase-change heat storage module 15 absorbs and stores the heat, and the phase-change heat storage module 15 functions for heat recovery. When the temperature T9 of the phase-change heat storage module 15 reaches a required temperature Tx1, the opening of the second throttling device 11 is reduced to the standby opening of 56P, so that the phase-change heat storage module 15 does not absorb heat, the phase-change heat storage module 15 is in a standby state, and the whole system is controlled as normal.

When the outdoor unit enters the defrosting mode, the second throttling device 11 is opened to the maximum opening degree of 480P, the first switching device 4 is in the power-off state, the second switching device 5 is in the power-off state, and the third switching device 6 is in the power-on state, and the hydraulic module keeps heating. At this time, the high-temperature and high-pressure gaseous refrigerant flows through the outdoor unit heat exchanger to defrost the outdoor unit fin type heat exchanger 7, and then flows to the phase-change heat storage module 15, so that the refrigerant evaporates in the phase-change heat storage module 15 to absorb heat, thereby ensuring that the defrosting process does not affect the operating state of the hydraulic module.

When the indoor unit is in the heating mode and the hydraulic module is also producing hot water, the phase-change heat storage module 15 starts to store heat. At this time, the first switching device 4 is in the power-on state, the second switching device 5 is in the power-on state, and the third switching device 6 is in the power-off state. The high-temperature and high-pressure refrigerant is condensed through the hydraulic module, the phase-change heat storage module 15, or the indoor unit, and evaporated in the outdoor unit, while the phase-change heat storage module 15 is caused to store heat. When the temperature T9 of the internal sensor of the phase-change heat storage module 15 is checked as that the phase-change heat storage temperature is lower than a required temperature Tx2, the second throttling device 11 is opened to the maximum of 480P, the refrigerant passes through the phase-change heat storage module 15 or the hydraulic module, and then enters the outdoor unit to evaporate. The phase-change heat storage module 15 absorbs and stores the heat, and the phase-change heat storage module 15 functions for heat recovery. When the temperature T9 of the phase-change heat storage module 15 reaches a required temperature Tx1, the opening of the second throttling device 11 is reduced to the standby opening of 56P, so that the phase-change heat storage module 15 does not absorb heat, the phase-change heat storage module 15 is in a standby state, and the whole system is controlled as normal.

When the outdoor unit enters the defrosting mode, the second throttling device 11 is opened to the maximum opening degree of 480P, the first switching device 4 is in the power-on state, the second switching device 5 is in the power-off state, and the third switching device 6 is in the power-on state. At this time, the high-temperature and high-pressure gaseous refrigerant flows through the outdoor unit heat exchanger to defrost the outdoor unit fin type heat exchanger 7, and then flows to the phase-change heat storage module 15 so that the refrigerant evaporates and absorbs heat in the phase-change heat storage module 15. At the same time, since the state of the first switching device 4 remains unchanged, it is ensured that the defrosting process does not affect the operation states of the hydraulic module and the indoor unit.

When the indoor unit is in the heating mode, the phase-change heat storage module 15 starts to store heat. At this time, the first switching device 4 is in the power-on state, the second switching device 5 is in the power-on state, the third switching device 6 is in the power-off state, and the solenoid valve 26 of the hydraulic module is fully closed. The high-temperature and high-pressure refrigerant is condensed through the phase-change heat storage module 15 or the indoor unit, and evaporated in the outdoor unit, while the phase-change heat storage module 15 is caused to store heat. When the temperature T9 of the internal sensor of the phase-change heat storage module 15 is checked as that the phase-change heat storage temperature is lower than a required temperature Tx2, the second throttling device 11 is opened to the maximum of 480P, the refrigerant passes through the phase-change heat storage module 15 or the hydraulic module, and then enters the outdoor unit to evaporate. The phase-change heat storage module 15 absorbs and stores the heat, and the phase-change heat storage module 15 functions for heat recovery. When the temperature T9 of the phase-change heat storage module 15 reaches a required temperature Tx1, the opening of the second throttling device 11 is reduced to the standby opening of 56P, so that the phase-change heat storage module 15 does not absorb heat, the phase-change heat storage module 15 is in a standby state, and the whole system is controlled as normal.

When the outdoor unit enters the defrosting mode, the second throttling device 11 is opened to the maximum opening degree of 480P, the first switching device 4 is in the power-on state, the second switching device 5 is in the power-off state, the third switching device 6 is in the power-on state, and the operating state of the indoor unit remains unchanged. At this time, the high-temperature and high-pressure gaseous refrigerant flows through the outdoor unit heat exchanger to defrost the outdoor unit fin type heat exchanger 7, and then flows to the phase-change heat storage module 15 so that the refrigerant is evaporated in the phase-change heat storage module 15 to absorb heat, thereby ensuring that the defrosting process does not affect the operating state of the indoor unit.

The above embodiments are only preferred embodiments of the present invention, and do not limit the present invention in any form. More possible changes and modifications or modifications made by any person skilled in the art to the technical solution of the present invention by using the technical content disclosed above without departing from the scope of the technical solution of the present invention are all equivalent embodiments of the present invention. Therefore, without departing from the content of the technical solution of the present invention, equivalent changes made according to the idea of the present invention shall all be covered within the protection scope of the present invention.

What is claimed is:

1. A non-stop defrosting multi-connected hot water system, comprising:

an outdoor unit comprising a compressor (1), a high-pressure pressure sensor (2), an oil separator (3), a first switching device (4), a second switching device (5), a third switching device (6), a fin type heat exchanger (7), a plate type heat exchanger (9), a first throttling device (10), a second throttling device (11), a third throttling device (12), an outdoor unit fan (14), and a phase-change heat storage module (15) with a heat storage function, and further comprising an outdoor unit ambient temperature sensor (16) configured to detect an ambient temperature of the outdoor unit in real time and a phase-change heat storage module temperature sensor (17) configured to detect a temperature of the phase-change heat storage module (15) in real time;

multi-connected indoor units, at least one indoor unit comprising an indoor unit heat exchanger (18), a fourth throttling device, an indoor unit fan (19), and an indoor unit ambient temperature sensor (20) configured to detect an ambient temperature of the indoor unit in real time, wherein the indoor unit heat exchanger (18) is further provided with an indoor unit heat exchanger central temperature sensor (21) and an indoor unit heat exchanger outlet temperature sensor (22) that are configured for real-time detection; and a hydraulic module comprising a refrigerant water heat exchanger (23), a water pump (24), a water flow switch (25), a solenoid valve (26), and a water temperature detection sensor (27);

wherein working modes of the outdoor unit, the indoor unit, and the hydraulic module comprise a cooling mode, a heating mode, a standby mode, and a defrosting mode, and based on energy requirements of the working mode of the system, actions of components in the outdoor unit, the indoor unit, and the hydraulic module are respectively adjusted correspondingly:

when the indoor unit and the hydraulic module are in the standby mode, by checking a T4 temperature of the outdoor unit ambient temperature sensor (16), when the ambient temperature is lower than TS2, it is defaulted to enter a standby heat storage mode, the first switching device (4) is in a power-off state, the second switching device (5) is in a power-on state, and the third switching device (6) is in a power-off state;

when the indoor unit is in the cooling mode and the hydraulic module enters the heating mode, the phase-change heat storage module (15) starts to store heat, and at this time, the first switching device (4) is in the power-off state, the second switching device (5) is in the power-on state, and the third switching device (6) is in the power-off state;

when the outdoor unit enters the defrosting mode, the second throttling device (11) is opened to the maximum opening degree of 480P, the first switching device (4) is in the power-off state, the second switching device (5) is in the power-off state, and the third switching device (6) is in the power-on state;

when the indoor unit is in the standby mode and the hydraulic module enters the heating mode to make hot water, the phase-change heat storage module (15) starts to store heat, the first switching device (4) is in the power-off state, and the second switching device (5) is in the power-on state, and the third switching device (6) is in the power-off state;

when the outdoor unit enters the defrosting state, the second throttling device (11) is opened to the maximum opening degree of 480P, the first switching device (4) is in the power-off state, the second switching device (5) is in the power-off state, the third switching device (6) is in the power-on state, and the hydraulic module keeps heating;

when the indoor unit is in the heating mode and the hydraulic module is also making hot water, the phase-change heat storage module (15) starts to store heat, the first switching device (4) is in the power-on state, the second switching device (5) is in the power-on state, and the third switching device (6) is in the power-off state;

when the outdoor unit enters the defrosting mode, the second throttling device (11) is opened to the maximum opening degree of 480P, the first switching device (4) is in the power-on state, the second switching device (5) is in the power-off state, and the third switching device (6) is in the power-on state;

when the indoor unit is in the heating mode, the phase-change heat storage module (15) starts to store heat, and at this time, the first switching device (4) is in the power-on state, the second switching device (5) is in the power-on state, and the third switching device (6) is in the power-off state; and when the outdoor unit enters the defrosting mode, the second throttling device (11) is opened to the maximum opening degree of 480P, the first switching device (4) is in the power-on state, the second switching device (5) is in the power-off state, the third switching device (6) is in the power-on state, and the operating state of an internal unit remains unchanged.

2. The non-stop defrosting multi-connected hot water system according to claim 1, further comprising a liquid side stop valve (28), a gas side stop valve (29), and a hydraulic module stop valve (30) that are connected to the outside of the outdoor unit.

3. The non-stop defrosting multi-connected hot water system according to claim 2, wherein the liquid side stop valve (28) is connected to an indoor unit liquid pipe and a hydraulic module liquid pipe.

4. The non-stop defrosting multi-connected hot water system according to claim 2, wherein the gas side stop valve (29) is connected to an indoor unit gas pipe.

5. The non-stop defrosting multi-connected hot water system according to claim 2, wherein the hydraulic module stop valve (30) is connected to a hydraulic module gas pipe.

6. The non-stop defrosting multi-connected hot water system according to claim 1, wherein the first throttling device (10), the second throttling device (11), the third throttling device (12), and the fourth throttling device (13) are all electronic expansion valves.

7. The non-stop defrosting multi-connected hot water system according to claim 1, wherein the first switching device (4), the second switching device (5), and the third switching device (6) are all four-way valves.

8. The non-stop defrosting multi-connected hot water system according to claim 1, wherein the compressor (1) adopts a frequency conversion compressor, a fixed speed compressor, or a digital compressor.

9. The non-stop defrosting multi-connected hot water system according to claim 1, according to claim 1, wherein a value measured by the indoor unit ambient temperature sensor (20) is defined as T1, a value measured by the indoor unit heat exchanger central temperature sensor (21) is defined as T2, a value measured by the indoor unit heat exchanger outlet temperature sensor (22) is defined as T2B, a value measured by the phase-change heat storage module temperature sensor (17) is defined as T9, and a value measured by the outdoor unit ambient temperature sensor (16) is defined as T4.

* * * * *